US011939030B1

(12) United States Patent
Ren et al.

(10) Patent No.: US 11,939,030 B1
(45) Date of Patent: Mar. 26, 2024

(54) MARINE INFORMATION INTEGRATED ONLINE MONITORING BUOY SYSTEM

(71) Applicant: Marine Environment Monitoring Center Station of Guangxi Zhuang Autonomous Region, Beihai (CN)

(72) Inventors: Chaoxing Ren, Beihai (CN); Wenlu Lan, Beihai (CN)

(73) Assignee: Marine Environment Monitoring Center Station of Guangxi Zhuang Autonomous Region, Beihai (CN)

( * ) Notice: Subject to any disclaimer, the term of this patent is extended or adjusted under 35 U.S.C. 154(b) by 0 days.

(21) Appl. No.: 18/455,634

(22) Filed: Aug. 25, 2023

(30) Foreign Application Priority Data

Sep. 28, 2022 (CN) ..... 202211188319.2

(51) Int. Cl.
*B63B 22/04* (2006.01)
*B63B 22/00* (2006.01)

(52) U.S. Cl.
CPC ..... *B63B 22/04* (2013.01); *B63B 2022/006* (2013.01)

(58) Field of Classification Search
CPC ... B63B 22/00; B63B 22/04; B63B 2022/006; B63B 22/18; B63B 22/24
USPC ..... 441/1, 21, 23, 32
See application file for complete search history.

(56) References Cited

U.S. PATENT DOCUMENTS

| | | | | |
|---|---|---|---|---|
| 5,654,692 | A * | 8/1997 | Baxter, Jr. | G08B 21/16 340/623 |
| 7,289,907 | B2 | 10/2007 | Meinig et al. | |
| 8,723,355 | B2 * | 5/2014 | Eder | F03B 13/16 290/43 |
| 10,067,507 | B2 | 9/2018 | Davoodi et al. | |
| 10,281,917 | B2 | 5/2019 | Tyers | |
| 10,571,530 | B2 * | 2/2020 | Hansen | G01R 33/032 |
| 11,327,186 | B2 * | 5/2022 | Pei | H04L 67/12 |

FOREIGN PATENT DOCUMENTS

| | | | |
|---|---|---|---|
| CN | 210198447 | U | 3/2020 |
| CN | 213502800 | U | 6/2021 |
| CN | 214985915 | U | 12/2021 |
| CN | 114435542 | B | 5/2022 |

* cited by examiner

*Primary Examiner* — Daniel V Venne
(74) *Attorney, Agent, or Firm* — True Shepherd LLC; Andrew C. Cheng

(57) ABSTRACT

A marine information integrated online monitoring buoy system comprises a buoy body. Specifically, a protection apparatus is disposed outside the buoy body. A bearing is disposed outside the buoy body, convex strips are arranged around a bearing outer ring, two floating rings are disposed outside the bearing outer ring with a certain spacing distance from the outer ring and arranged vertically, a protective cylinder is arranged between the upper and lower floating rings in a surrounding manner and is rotatable relative to the floating rings, and then a protective retaining ring is sleeved outside the protective cylinder and is rotatable relative to the protective cylinder. The longest end of a protective retainer is abutted against the bearing outer ring during rotation of the outer side of the protective retaining ring, and a friction block is disposed on the protective retainer.

6 Claims, 9 Drawing Sheets

MARINE INFORMATION INTEGRATED ONLINE MONITORING BUOY SYSTEM

CROSS-REFERENCE TO RELATED APPLICATIONS

This application claims priority to Chinese Patent Application No. 202211188319.2 with a filing date of Sep. 28, 2022. The content of the aforementioned application, including any intervening amendments thereto, is incorporated herein by reference.

TECHNICAL FIELD

The present invention belongs to the field of marine buoys, and in particular relates to a marine information integrated online monitoring buoy system.

BACKGROUND ART

A marine environment online monitoring system may perform continuous online monitoring for water quality in a monitored sea area, acquire the change of the water quality in the monitored sea area in real time, and learn the change trend of the water quality in the monitored sea area, thereby providing a scientific and effective basic support for marine environmental protection, marine pollution prevention and restoration and other work.

The marine environment online monitoring system is required to be completely automatically operated under an unattended condition to realize continuous marine environment monitoring in real time, so as to cope with severe challenges such as high temperature, high salinity, high humidity and biological adhesion. Thus, many technologies are provided in the prior art to solve the above-mentioned problems. For example, Chinese patent No. CN 114435542 B provides a buoy mechanism for monitoring a marine environment, in which an anti-collision strip is designed to achieve an effect in protecting a buoy. Specifically, an end of the anti-collision strip tilts upward under the action of buoyancy and floats on the sea surface. Therefore, if a ship hull or another floating object collides with the buoy, the end of the anti-collision strip tilting upward will be collided preferentially, such that an upper end of the ship hull or the floating object is prevented from tilting outward and from further colliding with a monitoring mechanism at an upper end of the buoy body, thereby achieving a good effect in protecting the monitoring mechanism on the buoy. However, the technology in terms of buoy protection such as sea current impact prevention in the prior art still has room for improvement.

SUMMARY OF THE PRESENT INVENTION

An object of the present invention is to provide a marine information integrated online monitoring buoy system with good wind and wave resistance, good stability and adjustable buoyancy.

To achieve the above object, the following technical solution is adopted in the present invention.

A marine monitoring buoy, includes: a buoy body, wherein a buoy upper layer apparatus is disposed on the buoy body;

a monitoring system, wherein the monitoring system is disposed on the buoy body or the buoy upper layer apparatus and composed of a monitoring instrument, and the monitoring instrument includes at least a state sensor, a water quality monitor, a hydrological monitor and a meteorological monitoring instrument;

an energy system, wherein the energy system is disposed on the buoy upper layer apparatus or inside the buoy body, and includes a solar power supply apparatus and a storage battery apparatus; and a data acquisition and control system, wherein the data acquisition and control system is disposed inside the buoy body and has a storage function; wherein a protection apparatus is disposed outside the buoy body and connected to the buoy body through a bearing, convex strips are disposed on a bearing outer ring on a side surface of the bearing, a connecting rod is disposed at an end of the bearing outer ring, the bearing outer ring is connected to a floating ring through the connecting rod, two floating rings are disposed correspondingly, and a protective cylinder is disposed between the floating rings and sleeved with a protective retaining ring. According to the present invention, the convex strips are arranged around the bearing outer ring, two floating rings are disposed outside the bearing outer ring with a certain spacing distance from the outer ring and arranged vertically, a protective cylinder is arranged between the upper and lower floating rings in a surrounding manner and is rotatable relative to the floating rings, and then a protective retaining ring is sleeved outside the protective cylinder and is rotatable relative to the protective cylinder; at the same time, the longest end of a protective retainer is abutted against the bearing outer ring during rotation of the outer side of the protective retaining ring, and a friction block is disposed on the protective retainer, such that the friction block on the protective retainer is abutted and rubbed against the convex strip on the bearing outer ring to drive the rotation of the protection apparatus, thereby dissipating the impulse of seawater. The protective cylinder is hollow inside, strip-shaped through grooves are arranged around a side surface of the protective cylinder, an outer side of the protective cylinder is sleeved with an assembly hole of the protective retaining ring, and friction grooves are disposed on an outer side of the protective retainer of the protective retaining ring. Since the protective retainer is abutted against the bearing outer ring, a rotary force thereof can be transmitted to the bearing outer ring during rotation of the protective retaining ring to further drive the bearing outer ring to rotate. The buoy of the present invention improves the buoyancy through the buoy body and related floating ring structures; the buoy body and the related floating ring structures achieve effects in weakening wave impact and preventing collision in the periphery of the buoy; the protective cylinder and the protective retaining ring in the solution can drive the outer ring to rotate during use, which has a wave prevention effect and a self-cleaning effect, and can disperse the wave impact in a single direction to the whole through the rotation of the outer ring, so as to reduce the shaking of the floating body due to the impact; and the buoy body and the related structures of the floating rings, the protective cylinder and the protective retaining ring in the solution reduce a possibility of overturning in wind and waves.

Preferably, the meteorological monitoring instrument is disposed at the top of the buoy upper layer apparatus, a radar reflector, a data transmission antenna, a GPS positioning apparatus and a warning light beacon are disposed in an upper portion of the buoy upper layer apparatus, and a solar panel is disposed in a lower portion of the buoy upper layer apparatus.

Preferably, the water quality monitor and the hydrological monitor are disposed at the bottom of the buoy body, and the state sensor, a storage battery, a data sending module and a data acquisition module are disposed inside the buoy body.

Preferably, a protective cylinder is disposed between the floating rings, hollow inside, provided with strip-shaped through grooves and sleeved with a protective retaining ring, and a bearing is disposed at an end of the protective cylinder and connected to the floating rings.

Preferably, a protective retainer is correspondingly disposed on the protective retaining ring, and a through hole and a friction block are disposed on the protective retainer.

Preferably, annular grooves are disposed at the bottom of the buoy body. The annular grooves additionally disposed at the bottom of the buoy body may reduce the shaking of the bottom of the buoy body against sea current impact.

Preferably, the mooring system includes a buoyancy adjustment apparatus and a counterweight that are connected by an anchor chain.

More preferably, the buoyancy adjustment apparatus is provided with a buoyancy adjustment apparatus housing, a counterweight and a floating body, the counterweight is connected to the floating body, and the buoyancy adjustment apparatus is connected to the counterweight of the mooring system by an anchor chain and the buoy body. According to the present invention, the buoyancy adjustment apparatus is disposed on the mooring system, a floating body is placed inside the buoyancy adjustment apparatus housing, and the counterweight is disposed in the periphery of the floating body to ensure that a buoyancy adjustment component is suspended in water. The buoyancy adjustment component of the present invention is disposed in the water and serves to have a pull-down positioning function for the entire buoy, so as to prevent the buoy from floating/drifting due to wave impact in an excessively large range during floating on the sea surface. The designed buoyancy adjustment component bears a part of gravity of the chain to facilitate controlling the buoyancy of the buoy on the water surface; and adjusts the center of gravity of the floating body in the water.

Preferably, the monitoring system may be further provided with at least one of a sea current sensor, a nutrient salt online monitor, an oil-in-water monitor and a wave monitor.

Preferably, the buoy is equipped with a positioning system.

Preferably, the buoy is equipped with an automatic alarm system, which alarms automatically when dissolved oxygen, chlorophyll, or the like exceeds a set range or the battery voltage is too low.

Preferably, the data acquisition and control system is operated independently, and stores measured data in the case of an instrument failure or system failure, wherein raw data may be stored for at least two years.

Preferably, the monitoring instrument in the monitoring system is separated from the detected seawater, and has an independent detection cavity.

The present invention discloses a marine information online monitoring buoy system, including: the above-mentioned marine monitoring buoy;

a communication system, including at least one of 3G, 4G, GPRS and satellite communication; and a system terminal, wherein the marine monitoring buoy transmits monitored marine information to the system terminal through the communication system.

Preferably, the system terminal has data verification and data quality inspection, data automatic loading, and data statistical arrangement modules for data automatically monitored by the buoy, to perform integration and unified management for marine monitoring/observation data.

Preferably, the system terminal is compatible with an information software interface to realize interconnection and intercommunication of the monitored data.

The marine monitoring buoy is mainly composed of a carrying platform, and a system integration and monitoring device, and may realize real-time online monitoring for a water environment in a monitored area and realize remote transmission of data.

The system is configured with devices such as instruments required for ensuring normal operation, a water intake system, a data acquisition and communication system, a power supply system and a safety warning apparatus, is capable of monitoring water quality on site as needed, and has a function for diagnosing an operation state of the system. The monitoring instrument configured for the system is the same type of instrument with a new model, and each sensor has stable and reliable performance, small calibration and drift, and little maintenance.

The buoy body is manufactured by a low-surface-energy polymer material with seawater corrosion resistance and sulfation resistance, anti-collision, a long life span, a long service period and a light weight, can prevent adhesion of various marine organisms, is convenient to clean, and may ensure that the buoy and the sensor acquire the monitored data stably and accurately for a long time. The buoy body should comply with the General Technical Requirements for Ocean Observation Buoys (National Marine Environmental Forecasting Center No. 689).

The buoy body adopts an upper and lower split structure, and a lower buoy platform has a cylindrical body to facilitate transportation, maintenance and mounting. Personnel are allowed to board the buoy body for operations, and the surface of the buoy body has anti-skid and protective functions to ensure safety of the personnel. A floating body of the buoy may be formed by a polyurea elastomer, and a phase material thereof may be a stainless steel. The buoy body has an overall height of not higher than 4.5 m, and the distance of a meteorological sensor from the water surface is not lower than 2.5 m; the buoy has a diameter of 2.5 m or more, a current receiving area of not more than 2.0 $m^2$, a wind receiving area of not more than 2.0 $m^2$, and net buoyancy of 2000 kg or more. An above-water portion of the buoy is of a streamlined inclined plane to ensure a mounting angle of a solar panel and lower a wind receiving surface; and an underwater portion of the buoy is of an inverted cone to effectively improve wave following performance.

The monitoring instrument in the monitoring system is disposed in the buoy. An electronic store of the buoy is designed with multiplex protection, an outer layer thereof can effectively resist wind and wave impact, and an electronic control store and an external watertight protection cabin have a waterproof grade above IP67, which may effectively protect a data acquisition module and other electronic components in the electronic store.

The monitoring instrument is a core component of the monitoring system. Combined with the development level of the current automatic monitoring technology, six monitoring instruments including a sea current sensor, a nutrient salt online monitor, an oil-in-water monitor, a multi-parameter water quality monitor, a meteorological monitor and a wave monitor may be selectively configured for different buoy stations. The sea current sensor may monitor at least the following two parameters: a velocity and a flow direction; the nutrient salt online monitor may monitor at least the following four parameters: nitrate, nitrite, ammonia nitrogen and active phosphate; the oil-in-water monitor may monitor parameters of oil substances in the seawater; the multi-parameter water quality monitor may monitor at least the following seven parameters: a water temperature, electrical conductivity, salinity, a pH value, dissolved oxygen, turbidity and chlorophyll; the meteorological monitor may monitor at least the following six parameters: an air temperature, an air pressure, humidity, a wind speed, a wind direction and a rainfall; and the wave monitor may monitor at least the following three parameters: a wave height, a wave direction and a wave period. The monitoring system is required to have sufficient extendibility to be extended and matched with other monitoring instruments according to requirements, and may carry a waste liquid recovery system. The monitoring instrument configured for the system is required to be the same type of instrument with a new model, which has stable and reliable performance, small drift, and little maintenance; a data acquisition and control unit has good compatibility and strong extendibility, and can support various general digital communication protocols; and a wireless transmission device for measuring data and instructions can transmit data and instructions in real time according to requirements with a strong anti-interference capability. The buoy has a built-in power source, and data acquisition and storage functions.

The entire marine buoy online monitoring system should be provided with functions for simultaneously and continuously monitoring seven marine environmental parameters or more, such as nitrate, nitrite, phosphate, ammonia nitrogen, a flow velocity, a flow direction and oil in water, and may be extended with other monitoring items such as an air temperature, an air pressure, humidity, a wind speed, a wind direction, a rainfall, a water temperature, electrical conductivity, salinity, a pH value, a redox potential, dissolved oxygen, turbidity, chlorophyll a and a wave.

The system should have a long maintenance period of instruments and sensors, may be continuously operated for 20 days or longer with accurate and reliable data. The system has a function of preventing discharge of pollutants to the surrounding environment. Cables and instrument interfaces of all instruments and sensors should have a protection level above IP65 to effectively resist corrosion of seawater and prolong the service life of instruments.

The energy system of the buoy is configured with solar panels and storage batteries. The total power of the solar panels is 300 W or more, and the total capacity of the storage batteries is 300 Ah or more. The solar panel is mounted in an embedded manner to be collision resistant and corrosion resistant. The mounting inclination angle is 20-40 degrees to effectively ensure the charging efficiency and satisfy waterproof and dustproof requirements.

The marine ecological buoy is required to be configured with a marine-grade solar power supply/storage system and a circuit protection apparatus, a lead-acid storage battery pack with a capacity of 400 AH or more, a solar panel of 300 W or more, and connecting cables. The apparatus may normally supply power to the marine monitoring buoy even for 20 consecutive rainy days to ensure the normal operation of the instrument. The solar panel should be resistant to wind and waves, collision and scratches, and seawater corrosion with a long service life.

Each monitoring buoy should have a solar power supply apparatus that may satisfy requirements of normal power supply to the system for 30 consecutive rainy days or more in the case of full power to ensure the normal operation of the system; and the solar panel has functions of high energy conversion efficiency, seawater corrosion resistance, wind and wave resistance, collision and scratch resistance, a long service life, and the like.

The above-water portion of the buoy body may be disposed as a streamlined inclined plane to ensure the mounting angle of the solar panel and lower the wind receiving surface. The solar panel is mounted in an embedded manner and at an inclination angle of 20-40 degrees to effectively ensure the charging efficiency and satisfy waterproof, dustproof and anti-collision requirements. An above-water sensor bracket is a triangular mast type bracket that may effectively reduce the wind receiving area to ensure the stability of the buoy under adverse weather conditions. The underwater portion of the buoy body is of an inverted cone to effectively improve the wave following performance.

In the data acquisition and control system of the buoy, the data acquisition and control unit of the system has good compatibility and strong extendibility, and can support different general digital communication protocols; the wireless transmission device for measuring data and instructions can transmit data and instructions in real time according to requirements with a strong anti-interference capability; and a data acquisition and control platform have a storage function to avoid loss of measured data in the case of an instrument failure or system failure. The marine monitoring buoys may be all configured with a data acquisition and transmission system.

The system should be operable in an environment of minus 20° C. to 55° C. The power source is 10-16 V, and the power is supplied by the storage battery to satisfy offshore solar power supply service requirements. The typical operation consumption is less than 100 mA; and the sleep state is less than 15 mA. The internal storage includes a 16 MB flash memory and a 32 MB SD memory, which may store more than 10,000,000.00 sets of data. The number of channels accessible to analog signals is 10 or more. The input voltage is −5 to 5V; and five or more external communication channels may be accessed simultaneously. Five or more differential ports are provided. The programmable gain magnifications are 0.5, 1, 2, 4 and 8. For the digital signal, eight user programmable digital I/O signals may be accessed. An interface RS232, an interface SDI12 and an analog interface of the system are required to satisfy system requirements, and a standby interface is reserved, wherein a channel RS232 may be used for access of a sensor compatible with a signal RS232, such as connection and control of a power supply voltage sensor, a Beidou terminal sensor, a water quality sensor, a meteorological sensor, a nutrient salt sensor and an oil-in-water sensor. Other interfaces are used for connecting other sensors. In the system of the present invention, monitoring instruments and sensors of water quality, meteorology, nutrient salt, sea currents, waves, and the like may be connected simultaneously. For the transmission mode, the system simultaneously supports Beidou communication transmission and 4G communication transmission, and supports a plurality of other wireless transmission modes.

In the mooring system of the buoy, the corrosion resistance and force receiving strength of the mooring system and the load of an anchor should ensure the long-term normal operation of the buoy for 2 years or longer in a harsh marine environment with a typhoon below category 10. The dimension and weight of mooring components should all satisfy requirements in Anchor Chains for Buoys Mooring Systems (JT/T100-2005).

In the mooring system of the buoy, single-point anchoring, Hall's anchor, or other moorings conforming to seabed geological conditions of a dropping place may be adopted. The anchor weight is 200 kg or more, or a weight that conforms to the seabed geological conditions of the dropping place, such that the buoy system may be reliably fixed in the designated sea area. The corrosion resistance and load capacity of components such as an anchor chain/swivel/shackle in the mooring system should all ensure the long-term normal operation of the buoy in the harsh marine environment.

The marine ecological buoy may be configured with an anti-theft apparatus with a good anti-theft protection function, and may also be equipped with a bottom mooring frame, a hoisting ring buoy bracket assembly, a corrosion-resistant buoy bracket, a sensor connecting cable, a top sensor bracket and a buoy maintenance kit which are matched with the buoy.

In the positioning system of the buoy, the system may be configured with a Beidou satellite positioning system with a real-time positioning function. For example, if the buoy drifts, the satellite positioning system may position the buoy in time (the positioning precision is less than 5 m), and send alarm information through a program. The configuration of the positioning system may be flexibly selected by the user according to different buoy stations. A GPS positioning system, a radar reflector and a warning light beacon may also be configured.

The alarm system of the buoy has an automatic alarm function. When some important parameters such as dissolved oxygen and chlorophyll exceed a set range or the battery voltage is too low, the system may send warning information through a program.

The buoy monitoring system should be equipped with devices such as a data acquisition and communication system, a power supply system, an instrument and sensor store, and a safety warning apparatus which are required for the normal operation, and provided with site maintenance dedicated software, standby instruments and tools.

The alarm system of the buoy may be provided with a warning sign. The warning sign and a contact sign may be provided on a bracket of the buoy body to help fishing boats or other sea vessels keep clear or contact. The corresponding information may also be spray-painted on the buoy body in a striking form.

The alarm system of the buoy may be equipped with a warning light beacon. The warning light beacon may be a novel LED lamp set with low power consumption and a long service life, and the visibility thereof should be 5 km or more.

In the communication system of the buoy, the buoy monitoring system should be configured with devices related to data acquisition, control, and the like, is capable of monitoring parameters such as site hydrology, water quality, meteorology, nutrient salt and oil in water according to requirements, and acquiring, storing and transmitting data, has a function of diagnosing a state of the parameters, and can remotely know battery power and a charging and discharging state of the system.

In the communication system of the buoy, a data acquisition and control platform has a data storage function to prevent the loss of measured data in the case of an instrument failure or system failure. The data acquisition system is operated independently, and has a built-in memory of 32 MB or more that may store more than 10,000,000 pieces of measured data and store raw data of the platform for more than 2 years.

The communication system of the buoy should have at least a Beidou satellite and GPRS dual communication mode, in which one is used while the other is standby to ensure the safety and reliability of data transmission.

In the system terminal of the buoy, the online monitoring data management and application service system should include buoy monitoring application service software and a relevant data comparison, calibration and evaluation model, which should be designed reasonably and combined closely. The platform should include a plurality of functional modules of data management, system management, evaluation and early warning, operation monitoring, map display, information publish, data sharing and the like to carry out business operational work of the automatic monitoring system of the buoy.

In the system terminal of the buoy, the software platform should meet the management and application of automatically-monitored data of the marine buoy and other multi-source data, and satisfy marine information service requirements. The system terminal of the buoy may realize manufacturing processes and visualization of various marine information products to provide marine environmental information services for government management departments, marine functional area management departments such as bathing beaches and coastal tourist areas, other sea-related enterprises, scientific research institutions, the public, and so on, and reserves interfaces with higher-level marine departments. The data communication format should comply with the General Technical Requirements for Ocean Observation Buoys (National Marine Environmental Forecasting Center No. 689).

In the system terminal of the buoy, the entire data model should include 15 or more models such as data comparison, data verification, sensor calibration, data quality control, data statistics, various index analysis, difference analysis, water environment statistical analysis and evaluation, biological environment statistical analysis and evaluation, sediment environment statistical analysis and evaluation, bathing beach environmental state comprehensive evaluation and early warning, coastal tourist area environmental state comprehensive evaluation and early warning, marine protected area environmental state comprehensive evaluation and early warning, marine aquaculture area environmental state comprehensive evaluation and early warning, red tide risk grade evaluation and early warning, estuary sewage state comprehensive evaluation, adjacent sea area environmental quality evaluation, oil overflow early warning, and strong wind and big wave early warning.

In the system terminal of the buoy, the entire marine information application service platform architecture should have high security to fully consider data security in the processes of automatically-monitored data transmission, management application and sharing, and especially consider the security of information sharing at different levels and in different network communication environments to ensure the security and reliability of data, users and system operation. The software platform should set authority level management and establish login, control and other interfaces to ensure that users with different authorities may log into different functional modules.

In the system terminal of the buoy, a database of the software platform adopts an advanced data management system at present and supports a plurality of data types.

In the system terminal of the buoy, the marine information application service platform should have a powerful data management function, and have sub-modules of data verification and data quality inspection for automatically-monitored data of the buoy, data automatic loading, data statistical arrangement, and the like to ensure the correctness and reliability of the loaded data. At the same time, the platform should be able to perform integration and unified management for multi-source data such as other types of marine monitoring/observation data, and may keep interface compatibility with other existing information software of the user to realize interconnection and intercommunication of the monitored data.

In the system terminal of the buoy, the software platform should have a powerful visualization function of displaying data and information products in different forms such as diagrams, tables and dials. At the same time, the platform has functions such as comprehensive evaluation of various marine environments and early warning of marine disasters in accordance with national and industrial standards with good extendibility.

The system terminal of the buoy should have functional sub-modules of buoy system station management, buoy system safety management, buoy system quality control management, buoy system maintenance management, monitoring parameter management, user authority management, operation log management, and the like; and may realize comprehensive management of basic data operated by the system.

In the system terminal of the buoy, according to the data models contained in the platform, statistical analysis and difference analysis may be performed for various indexes, comprehensive evaluation and early warning may be performed for the seawater environment and various marine functional areas, various marine disasters such as red tide may be warned early, and the environmental quality of sea areas near the estuary may be evaluated. Further, the platform has a powerful visualization function, and may display the above information products in different forms such as diagrams, tables, dashboards and maps.

In the system terminal of the buoy, key marine environmental parameters, marine disasters such as red tide, oil overflow and storm tide, and environmental conditions such as bathing beaches, coastal tourist areas and seawater aquaculture areas should be monitored in real time, wherein the red tide disaster should be warned early. At the same time, a buoy position, a buoy communication state, a buoy sensor state, and the like can be monitored in real time. When the buoy drifts, a buoy displacement trajectory may be tracked and drawn in real time. When early warning information is generated, relevant personnel may be notified in different forms to take timely treatment measures so as to ensure the normal operation of the system.

The system terminal of the buoy may have a map display function of displaying a plurality of layers such as station positions, parameters, functional areas, displacement trajectories, and early warning information, and may intuitively view station position distribution, and monitor parameter information, early warning information, and the like in real time.

The system terminal of the buoy may realize production and audit management of contents published via various publishing channels, wherein the information contents published via different channels are different to satisfy needs of different users. Publish objects, publish contents, publish frequency, and so on may all be flexibly set. The publishing channels may include information websites, mobile apps, WeChat applets, TVs, print media, mobile phone messages, and the like.

In the system terminal of the buoy, the monitored data may be shared among different institutions and departments according to actual needs; and information such as sharing objects, sharing stations and parameters, data sharing time periods, sharing methods and data transmission frequency may be flexibly set.

In the system terminal of the buoy, the software platform may have good compatibility and extendibility, and client software may be operated normally on an ordinary office computer and operated well in network environments of the Internet and Intranet.

In the system terminal of the buoy, the buoy data application service platform may process buoy data, and also perform unified management and processing for other types of marine monitoring/observation data; and may keep interface compatibility with other existing information software of the user for interconnection and intercommunication.

The present invention adopts a concept of "modular integration and block building" to realize high integration and facilitate maintenance. The monitoring instrument is separated from the detected seawater, and has an independent detection cavity to protect the instrument to the greatest extent, thereby completely solving the biological adhesion problem of the monitoring instrument and enhancing the stability and reliability of the system. The system of the present invention has a long maintenance period, a simple maintenance operation, and low operation and maintenance costs; the communication mode is flexible, the transmission may be performed through a wireless network such as 3G/4G and a satellite, the construction cost and the operation cost are much lower than those of cable transmission, and the communication channel is uneasy to destroy, such that the system has high stability. Therefore, the present invention is a marine information integrated online monitoring buoy system with good wind and wave resistance, good stability and adjustable buoyancy.

Numerals of the drawings are described as follows: 10-buoy body, 11-state sensor, 12-storage battery, 13-data sending module, 14-data acquisition module, 15-water quality monitor, 16-hydrological sensor, 20-buoy upper layer apparatus, 21-solar panel, 22-radar reflector, 23-data transmission antenna, 24-meteorological monitoring instrument, 25-GPS positioning apparatus, 26-warning light beacon, 30-mooring system, 31-buoyancy adjustment apparatus, 32-counterweight, 17-bearing, 18-bearing outer ring, 19-convex strip, 40-protection apparatus, 41-connecting rod, 42-floating ring, 43-protective cylinder, 44-protective retaining ring, 101-annular groove, 431-strip-shaped through groove, 432-bearing, 441-assembly hole, 442-protective retaining ring annular body, 443-through hole, 444-friction block, 445-protective retainer, 311-buoyancy adjustment apparatus housing, 312-counterweight, 313-anchor chain, and 314-floating body.

DESCRIPTION OF EMBODIMENTS

The technical solution of the present invention will be further described below in detail in conjunction with specific embodiments and accompanying drawings.

In the present invention, the following accompanying drawings are intended to briefly describe the present invention rather than uniquely limit the present invention.

Figure 1:
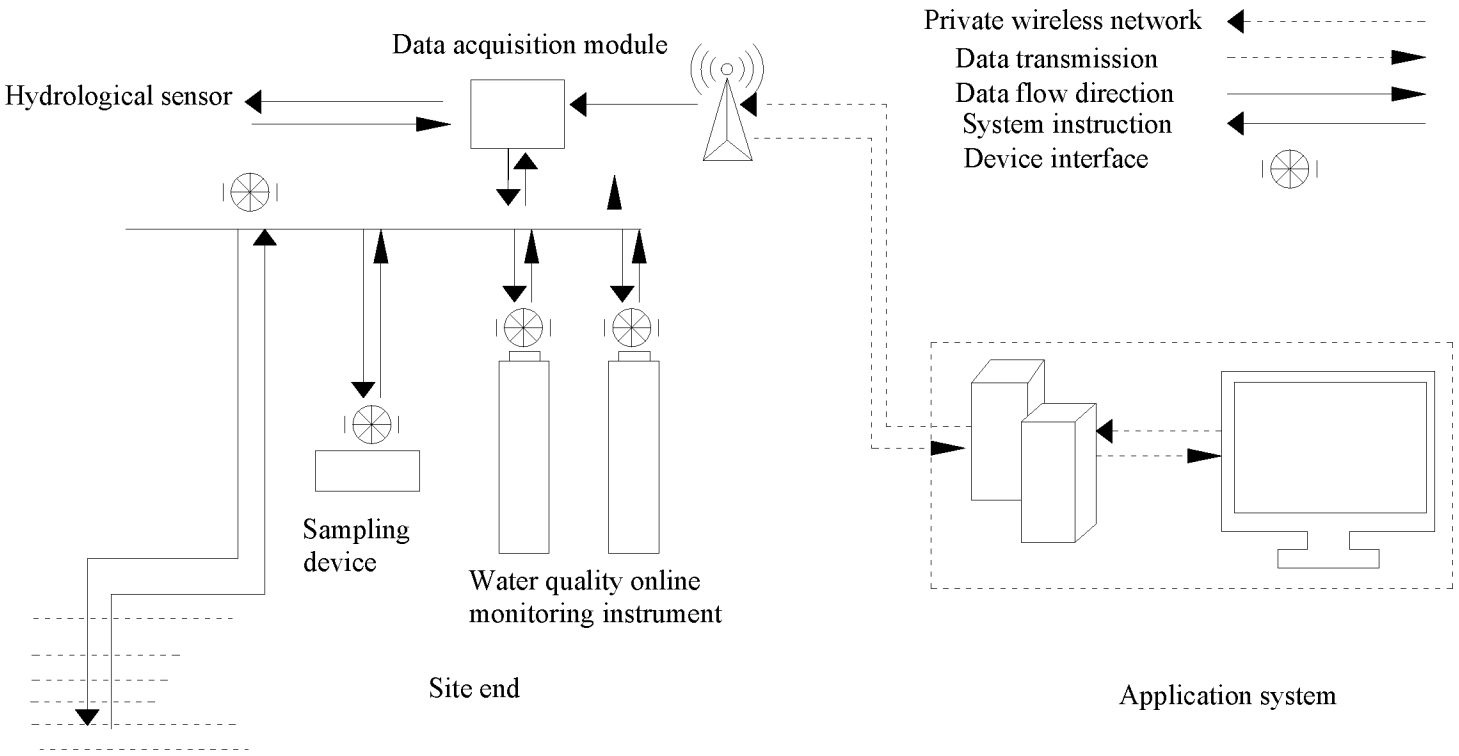
FIG. 1 is an overall schematic diagram of a marine environment online monitoring system.

FIG. 1 is an overall design diagram of a marine environment online monitoring system. The system includes a site end and an application system. The site end includes a hydrological sensor and a water quality sensor, a data acquisition module, a sampling apparatus and a device interface, and may communicate with the application system through a wireless network to send site data to a remote terminal.

Figure 2:
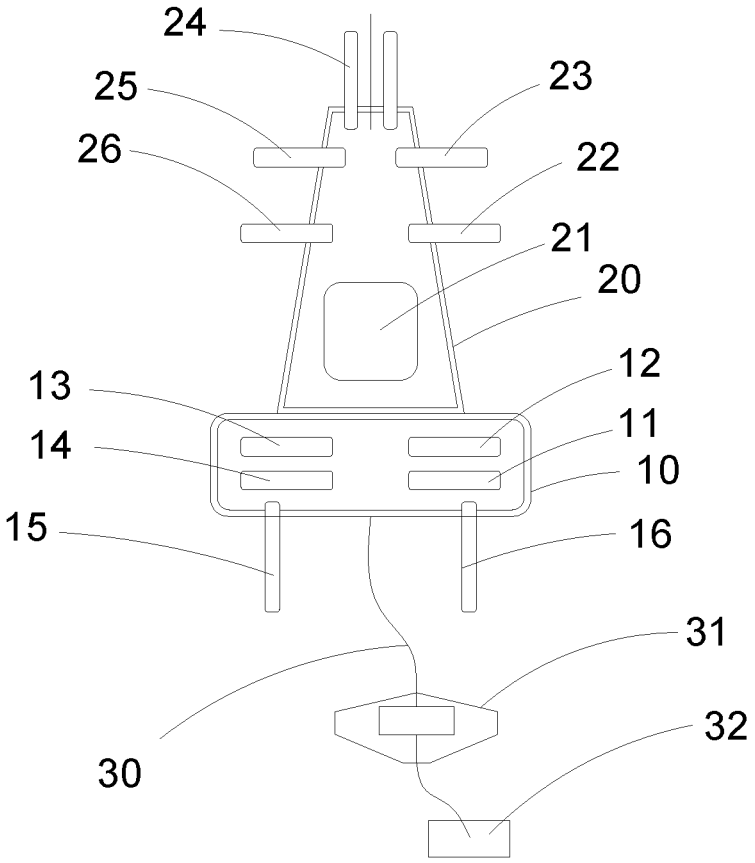
FIG. 2 is a schematic diagram of a floating body.

FIG. 2 is a partial schematic diagram of a floating body for simple explanation or summary. A marine buoy includes a buoy body, a state sensor, a storage battery, a data sending module, a data acquisition module, a water quality monitor, a hydrological monitor, a buoy upper layer apparatus, a solar panel, a radar reflector, a data transmission antenna, a meteorological monitoring instrument, a positioning apparatus, a warning light beacon, a mooring system, a buoyancy adjustment apparatus and a counterweight.

Figure 3:
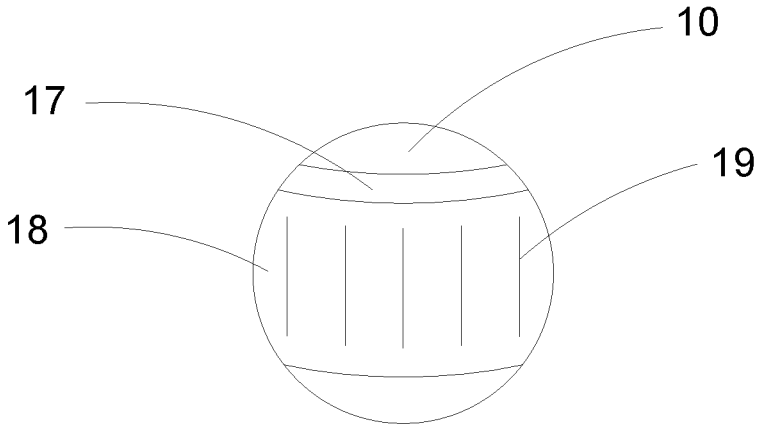
FIG. 3 is a schematic diagram of a bearing outer ring.

FIG. 3 is a schematic diagram of a bearing outer ring, on which convex strips are disposed.

Figure 4:
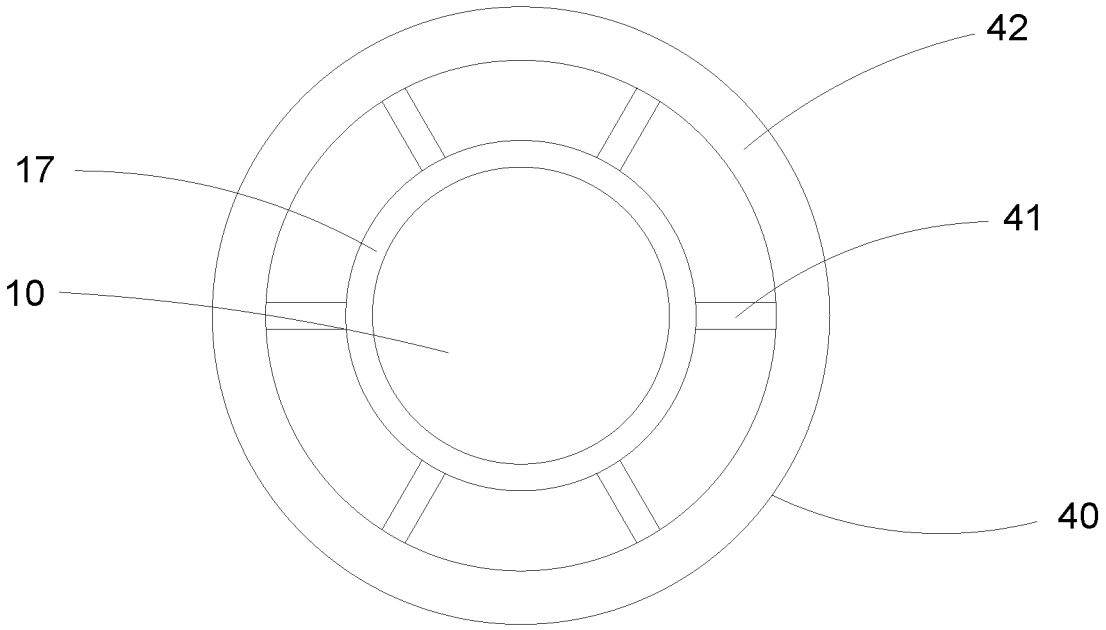
FIG. 4 is a schematic diagram of a floating ring.

FIG. 4 is a schematic diagram of a floating ring connected to a bearing outer ring through a connecting rod.

Figure 5:
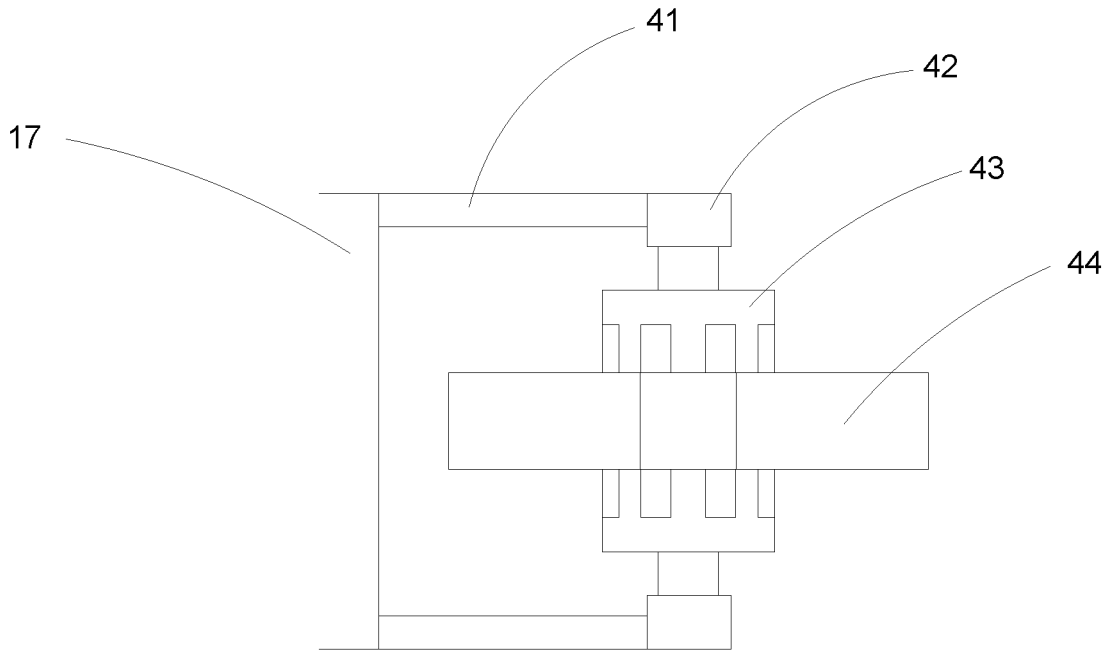
FIG. 5 is a schematic diagram of a combination of a protective cylinder and a protective retaining ring.

FIG. 5 is a schematic diagram of a combination of a protective cylinder and a protective retaining ring, in which a connecting rod, a floating ring, a protective cylinder and a protective retaining ring are disposed.

Figure 6:
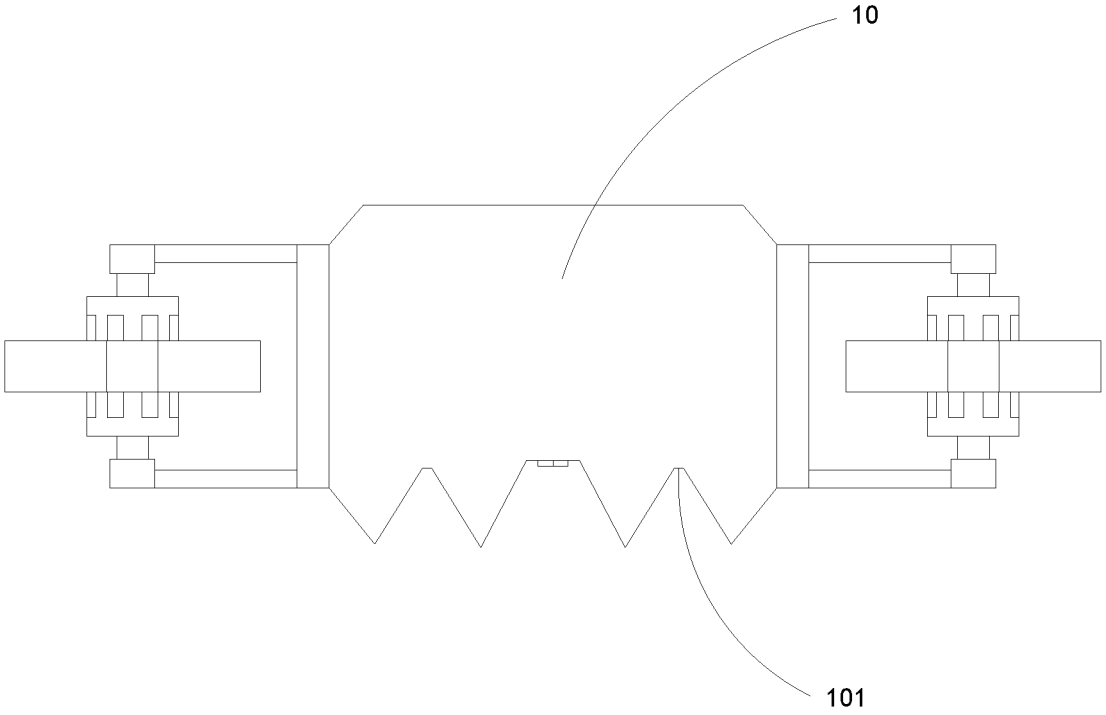
FIG. 6 is a schematic diagram of a buoy body and a protection apparatus.

FIG. 6 is a schematic diagram of a buoy body and a protection apparatus, wherein annular grooves are formed at the bottom of the buoy body.

Figure 7:
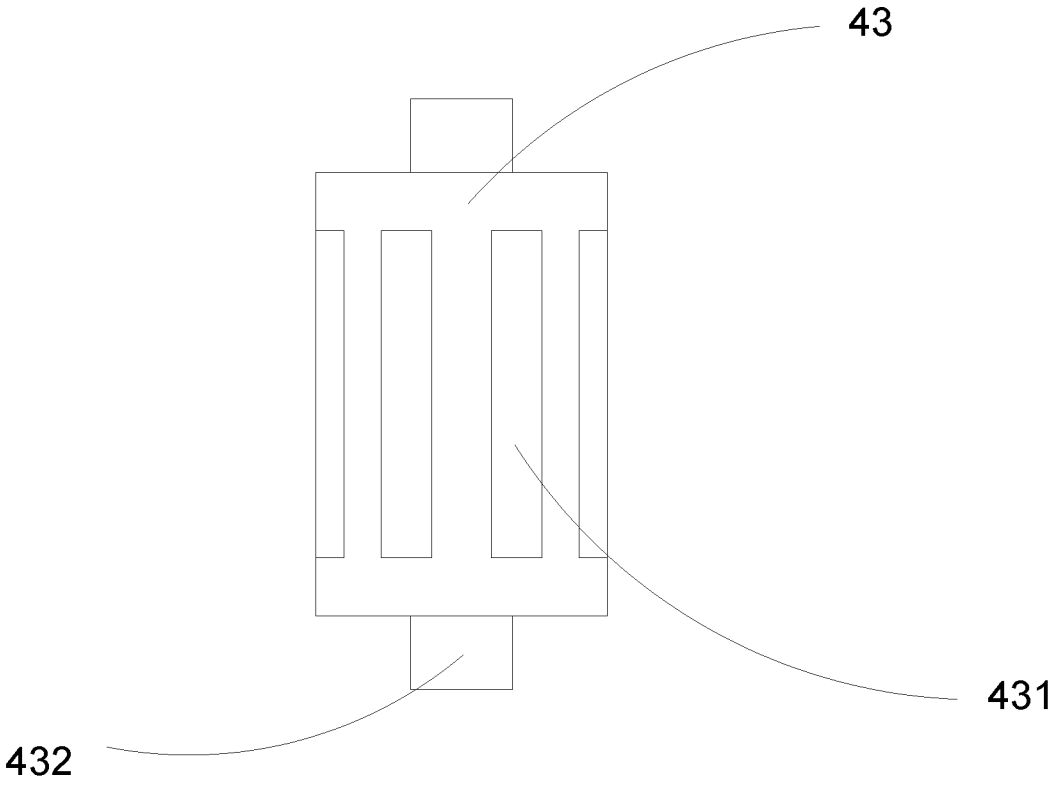
FIG. 7 is a schematic diagram of a protective cylinder.

FIG. 7 is a schematic diagram of a protective cylinder, on which strip-shaped through grooves and a bearing are disposed.

Figure 8:
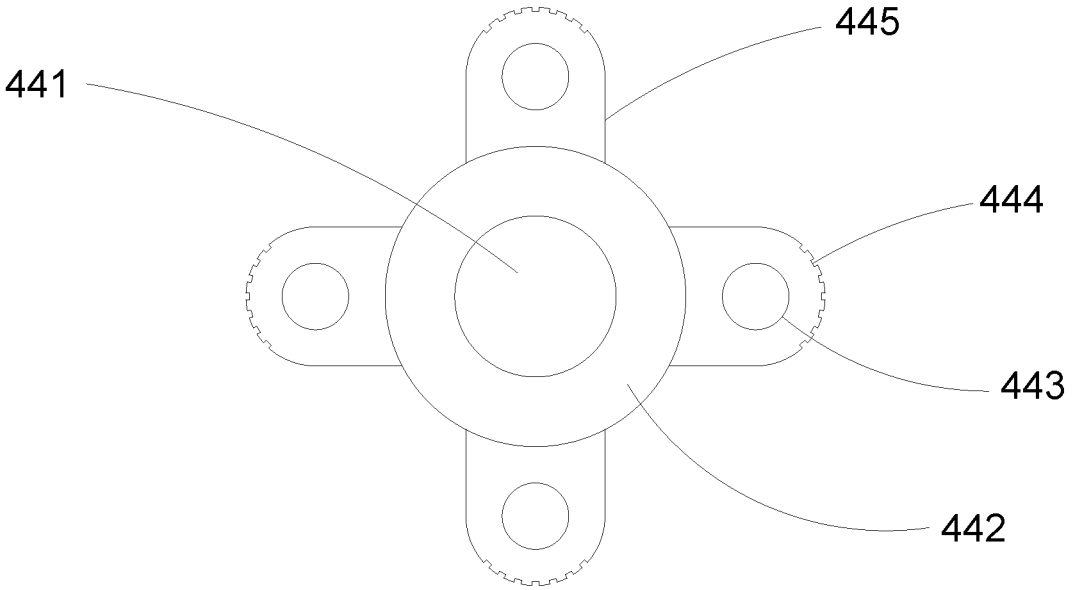
FIG. 8 is a schematic diagram of a protective retaining ring.

FIG. 8 is a schematic diagram of a protective retaining ring, in which an assembly hole, a protective retaining ring annular body, a through hole, a friction block and a protective retainer are disposed.

Figure 9:
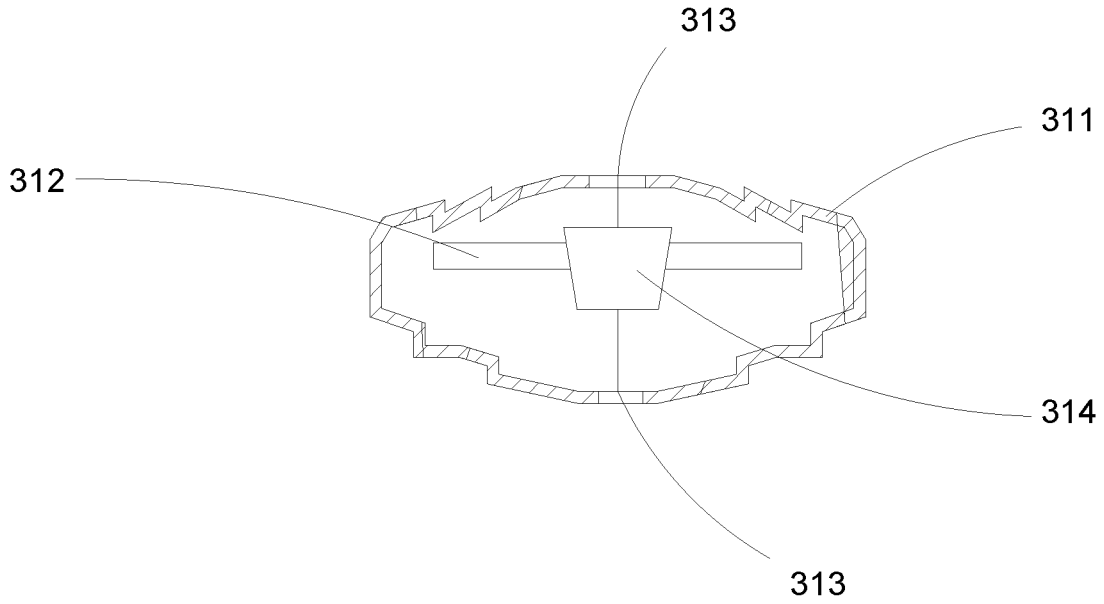
FIG. 9 is a schematic diagram of a buoyancy adjustment apparatus.

FIG. 9 is a schematic diagram of a buoyancy adjustment apparatus, wherein the buoyancy adjustment apparatus is provided with a buoyancy adjustment apparatus housing, a counterweight, an anchor chain and a floating body.

Embodiment 1

A marine monitoring buoy, including: a buoy body, wherein a buoy upper layer apparatus is disposed on the buoy body, a monitoring system, wherein the monitoring system is disposed on the buoy body or the buoy upper layer apparatus and composed of a monitoring instrument, and the monitoring instrument includes at least a state sensor, a water quality monitor, a hydrological monitor and a meteorological monitoring instrument;

an energy system, wherein the energy system is disposed on the buoy upper layer apparatus or inside the buoy body, and includes a solar power supply apparatus and a storage battery apparatus; and a data acquisition and control system, wherein the data acquisition and control system is disposed inside the buoy body and has a storage function.

A protection apparatus is disposed outside the buoy body and connected to the buoy body through a bearing, convex strips are disposed on a bearing outer ring on a side surface of the bearing, a connecting rod is disposed at an end of the bearing outer ring, the bearing outer ring is connected to a floating ring through the connecting rod, two floating rings are disposed correspondingly, and a protective cylinder is disposed between the floating rings and sleeved with a protective retaining ring.

Embodiment 2

Compared to the embodiment 1, a marine monitoring buoy in this embodiment is different in the buoy upper layer apparatus.

A meteorological monitoring instrument is disposed at the top of the buoy upper layer apparatus, a radar reflector, a data transmission antenna, a GPS positioning apparatus and a warning light beacon are disposed in an upper portion of the buoy upper layer apparatus, and a solar panel is disposed in a lower portion of the buoy upper layer apparatus.

Embodiment 3

Compared to the embodiment 1, a marine monitoring buoy in this embodiment is different in the buoy body.

A water quality monitor and a hydrological monitor are disposed at the bottom of the buoy body, and a state sensor, a storage battery, a data sending module and a data acquisition module are disposed inside the buoy body.

Embodiment 4

Compared to the embodiment 1, a marine monitoring buoy in this embodiment is different in that a protective cylinder is disposed between floating rings.

The protective cylinder is disposed between the floating rings, hollow inside, provided with strip-shaped through grooves and sleeved with a protective retaining ring, and a bearing is disposed at an end of the protective cylinder and connected to the floating rings.

Embodiment 5

Compared to the embodiment 1, a marine monitoring buoy in this embodiment is different in the protective retaining ring.

The protective retainer is correspondingly disposed on the protective retaining ring, and a through hole and a friction block are disposed on the protective retainer.

Embodiment 6

Compared to the embodiment 1, a marine monitoring buoy in this embodiment is different in the bottom of the buoy body.

Preferably, annular grooves are disposed at the bottom of the buoy body. The annular grooves additionally disposed at the bottom of the buoy body may reduce the shaking of the bottom of the buoy body against sea current impact.

Embodiment 7

Compared to the embodiment 1, a marine monitoring buoy in this embodiment is different in the mooring system.

The mooring system includes a buoyancy adjustment apparatus and a counterweight that are connected with each other through an anchor chain. The buoyancy adjustment apparatus is provided with a buoyancy adjustment apparatus housing, a counterweight and a floating body, the counterweight is connected to the floating body, and the buoyancy adjustment apparatus is connected to the counterweight of the mooring system through an anchor chain and the buoy body.

Embodiment 8

A marine monitoring buoy, including: a buoy body, wherein a buoy upper layer apparatus is disposed on the buoy body, a monitoring system, wherein the monitoring system is disposed on the buoy body or the buoy upper layer apparatus and composed of a monitoring instrument, and the monitoring instrument includes at least a state sensor, a water quality monitor, a hydrological monitor and a meteorological monitoring instrument;

an energy system, wherein the energy system is disposed on the buoy upper layer apparatus or inside the buoy body, and includes a solar power supply apparatus and a storage battery apparatus; and a data acquisition and control system, wherein the data acquisition and control system is disposed inside the buoy body and has a storage function.

A protection apparatus is disposed outside the buoy body and connected to the buoy body through a bearing, convex strips are disposed on a bearing outer ring on a side surface of the bearing, a connecting rod is disposed at an end of the bearing outer ring, the bearing outer ring is connected to a floating ring through the connecting rod, two floating rings are disposed correspondingly, and a protective cylinder is disposed between the floating rings and sleeved with a protective retaining ring.

The meteorological monitoring instrument is disposed at the top of the buoy upper layer apparatus, a radar reflector, a data transmission antenna, a GPS positioning apparatus and a warning light beacon are disposed in an upper portion of the buoy upper layer apparatus, and a solar panel is disposed in a lower portion of the buoy upper layer apparatus.

The water quality monitor and the hydrological monitor are disposed at the bottom of the buoy body, and the state sensor, a storage battery, a data sending module and a data acquisition module are disposed inside the buoy body.

A protective cylinder is disposed between the floating rings, hollow inside, provided with strip-shaped through grooves and sleeved with a protective retaining ring, and a bearing is disposed at an end of the protective cylinder and connected to the floating rings.

A protective retainer is correspondingly disposed on the protective retaining ring, and a through hole and a friction block are disposed on the protective retainer.

Preferably, annular grooves are disposed at the bottom of the buoy body. The annular grooves additionally disposed at the bottom of the buoy body can reduce the shaking of the bottom of the buoy body against sea current impact.

The mooring system includes a buoyancy adjustment apparatus and a counterweight that are connected with each other through an anchor chain. The buoyancy adjustment apparatus is provided with a buoyancy adjustment apparatus housing, a counterweight and a floating body, the counterweight is connected to the floating body, and the buoyancy adjustment apparatus is connected to the counterweight of the mooring system through an anchor chain and the buoy body.

The above embodiments are merely intended to be illustrative of the present invention, and are not intended to limit the present invention. Persons of ordinary skill in the art may further make various changes and modifications without departing from the spirit and scope of the present invention. Therefore, all equivalent technical solutions also belong to the scope of the present invention, and the patent protection scope of the present invention shall be defined by the claims.

What is claimed is:

1. A marine monitoring buoy, comprising a buoy body (10), wherein a buoy upper layer apparatus (20) is disposed on the buoy body (10);

a monitoring system disposed on the buoy body (10) or the buoy upper layer apparatus (20) and comprising a plurality of monitoring instruments, wherein the plurality of monitoring instruments comprise at least a state sensor (11), a water quality monitor (15), a hydrological monitor (16) and a meteorological monitoring instrument (24);

an energy system disposed on the buoy upper layer apparatus (20) or inside the buoy body (10), and comprising a solar power supply apparatus and a storage battery (12) apparatus;

a data acquisition and control system disposed inside the buoy body (10), and having a storage function; wherein a protection apparatus (40) is disposed outside the buoy body (10) and connected to the buoy body (10) through a bearing (17), convex strips (19) are disposed on a bearing outer ring (18) on a side surface of the bearing (17), a connecting rod (41) is disposed at an end of the bearing outer ring (18), the bearing outer ring (18) is connected to a floating ring (42) through the connecting rod (41), two floating rings (42) are disposed correspondingly, and a protective cylinder (43) is disposed between the floating rings (42) and sleeved with a protective retaining ring (44);

the protective cylinder (43) is hollow inside, provided with strip-shaped through grooves (431) and sleeved with the protective retaining ring (44), and a bearing (432) is disposed at an end of the protective cylinder (43) and connected to the floating rings; and a protective retainer (445) is correspondingly disposed on the protective retaining ring (44), and a through hole (443) and a friction block (444) are disposed on the protective retainer (445).

2. The marine monitoring buoy according to claim 1, wherein the meteorological monitoring instrument (24) is disposed at a top of the buoy upper layer apparatus (20); a radar reflector (22), a data transmission antenna (23), a positioning apparatus (25) and a warning light beacon (26) are disposed in an upper portion of the buoy upper layer apparatus (20); and a solar panel (21) is disposed in a lower portion of the buoy upper layer apparatus (20).

3. The marine monitoring buoy according to claim 1, wherein the water quality monitor (15) and the hydrological monitor (16) are disposed at a bottom of the buoy body (10); and the state sensor (11), a storage battery (12), a data sending module (13) and a data acquisition module (14) are disposed inside the buoy body (10).

4. The marine monitoring buoy according to claim 1, wherein annular grooves (101) are disposed at a bottom of the buoy body (10).

5. The marine monitoring buoy according to claim 1, further comprising a mooring system (30), wherein the mooring system (30) comprises a buoyancy adjustment apparatus (31) and a first counterweight (32) that are connected by an anchor chain (313).

6. The marine monitoring buoy according to claim 5, wherein the buoyancy adjustment apparatus (31) comprises a buoyancy adjustment apparatus housing (311), a second counterweight (312) and a floating body (314), the second counterweight (312) is connected to the floating body (314), and the buoyancy adjustment apparatus (31) is connected to the first counterweight (32) of the mooring system (30) by the anchor chain (313) and the buoy body (10).

* * * * *